United States Patent [19]

Gormley et al.

[11] Patent Number: 5,002,470

[45] Date of Patent: Mar. 26, 1991

[54] INTERNAL STATOR ROLLING ROTOR MOTOR DRIVEN SCROLL COMPRESSOR

[75] Inventors: Thomas P. Gormley, St. Louis, Mo.; James F. Crofoot, Kirkville, N.Y.

[73] Assignee: Carrier Corporation, Syracuse, N.Y.

[21] Appl. No.: 450,496

[22] Filed: Dec. 14, 1989

[51] Int. Cl.[5] ..... F04B 17/00; F04C 18/02

[52] U.S. Cl. ..... 417/410; 418/60

[58] Field of Search ..... 417/410; 418/60

[56] References Cited

U.S. PATENT DOCUMENTS 4,553,913 11/1985 Moushita et al. ..... 418/60

4,946,353 8/1990 Grofoot ..... 417/410

*Primary Examiner*—Leonard E. Smith

*Assistant Examiner*—David W. Scheuermann

*Attorney, Agent, or Firm*—David J. Zobkiw

[57] ABSTRACT

The center of gravity of the rotor of a rolling rotor motor and the center of gravity of the orbiting scroll(s) of a scroll compressor are located on diametrically opposite sides of the centerline of the stator. The rotor and orbiting scroll(s) are connected through a plurality of circumferentially spaced links which are pivotable about fixed axes whereby movement of the rotor produces movement of the orbiting scroll(s) while the orbiting scroll(s) serves as a counterweight with respect to the rotor.

11 Claims, 6 Drawing Sheets

ON AT OFF

ON BEFORE OFF

40
A
42-1
44-2
37
42
34
44-1
44
24
48
30-1
22
C
B
11
22-1
30-2
21
20
30
23-1
23
49
25
C
B
6
6
30-3
45
30-3
45
30-3
45
30-3
45
43-1
45-2
38
A
43
35
45-1

INTERNAL STATOR ROLLING ROTOR MOTOR DRIVEN SCROLL COMPRESSOR

BACKGROUND OF THE INVENTION

A rolling rotor motor is one in which only a portion of the windings are activated at any given time and the resultant asymmetric magnetic field is moved around the stator by changing which ones of the windings are the activated windings. This type of motor is characterized by high torque and low speed. Where the rotor is located internally of the stator, the coaction between the rotor and stator as a result of the asymmetric magnetic field, unless otherwise limited, is like that of the piston and cylinder of a rolling piston or reciprocating vane type compressor. As a result, the rotor may also be the piston of a rolling piston compressor such as is disclosed in U.S. Pat. No. 2,561,890. Since the rotor rolls around in contact with the stator, there are low bearing loads as compared to a motor in which the rotor is constrained to rotate about a fixed axis.

The rolling rotor motor can be integral with the compressor thereby reducing the size and number of parts such as shafts and bearings, but it has some inherent disadvantages. Because only some of the windings are activated at any particular time, the horsepower per pound of motor weight is less than it would be for an induction motor. Also, the rotor is dynamically unbalanced since its center traces a circular orbit as it moves circumferentially towards the activated windings due to magnetic attraction as it follows the rotating field while points on the rotor go through a hypocycloid motion. The unbalance forces increase with the square of the rotor speed thus making the motor unsuitable for high speed applications.

SUMMARY OF THE INVENTION

As the external rotor rolls around the stator, it drives an orbiting scroll through a series of circumferentially spaced links such that the orbiting scroll is maintained 180° out of phase with the rotor. The mass of the orbiting scroll is matched to that of the rotor so that dynamic mechanical balance is achieved. Also, the inherent radial compliance of the rotor to the stator is transferred through the links to the orbiting scroll element and its relationship with the fixed scroll. In a preferred embodiment an orbiting scroll element is driven by each end of the rotor and their cumulative mass is equal to that of the rotor so that effective counterweighting is maintained.

It is an object of this invention to dynamically balance a rolling rotor motor/compressor.

It is another object of this invention to adapt the orbital motion of a rolling rotor motor for driving a scroll compressor.

It is an additional object of this invention to provide a simplified drive for a scroll compressor while maintaining full compliance and dynamic mechanical balance.

It is further object of this invention to permit the rolling rotor to change its radius of operation. These objects, and others as will become apparent hereinafter, are accomplished by the present invention.

Basically, at least one orbiting scroll element is driven by the external rotor of a rolling rotor motor. Driving of the orbiting scroll is through a plurality of circumferentially spaced links which are pivoted on fixed pins such that the orbiting scroll is maintained 180° out of phase with the rotor with respect to the axis of the stator.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
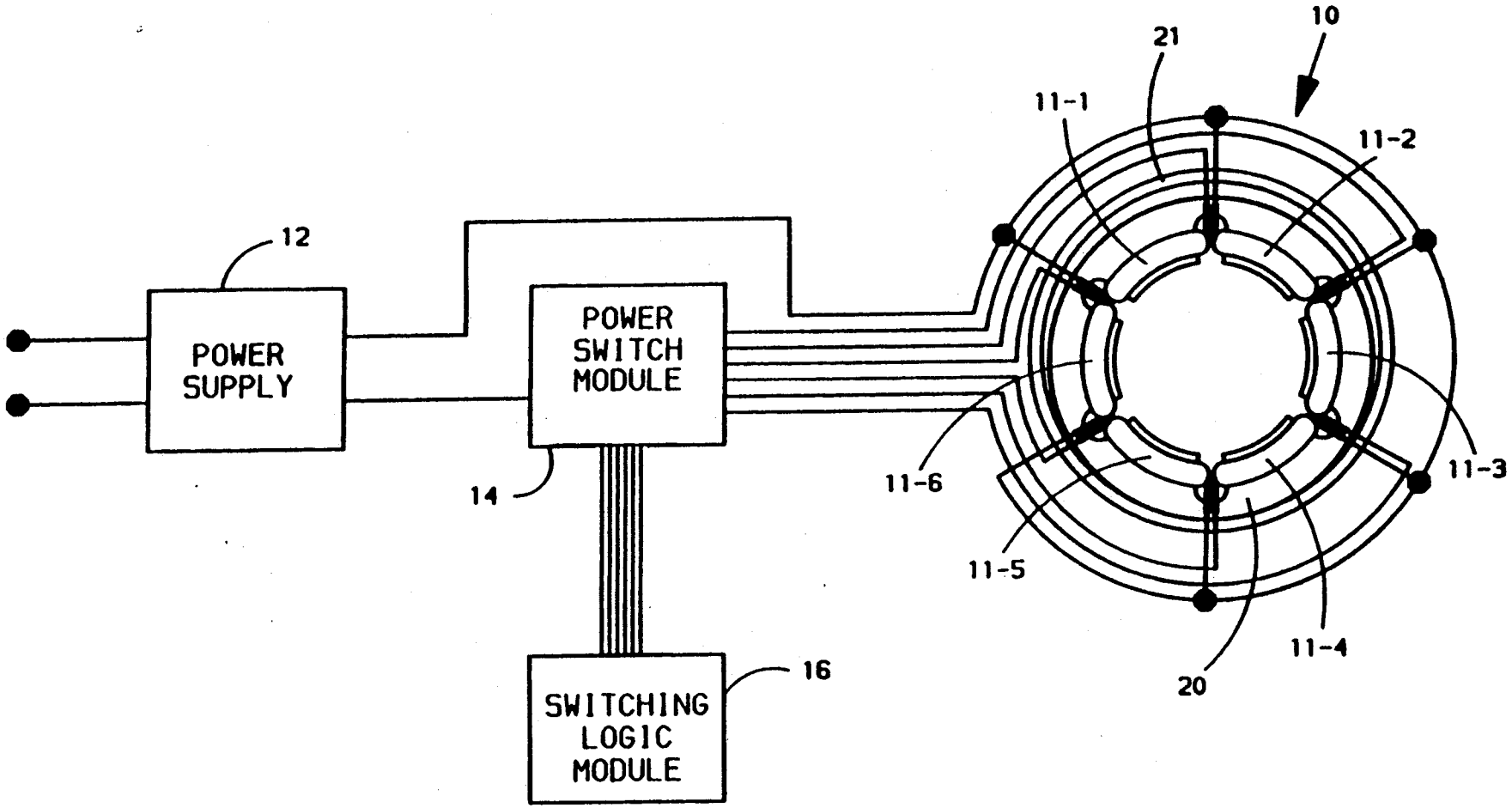
FIG. 1 is a circuit diagram for a rolling rotor motor/-compressor.
Figure 2:
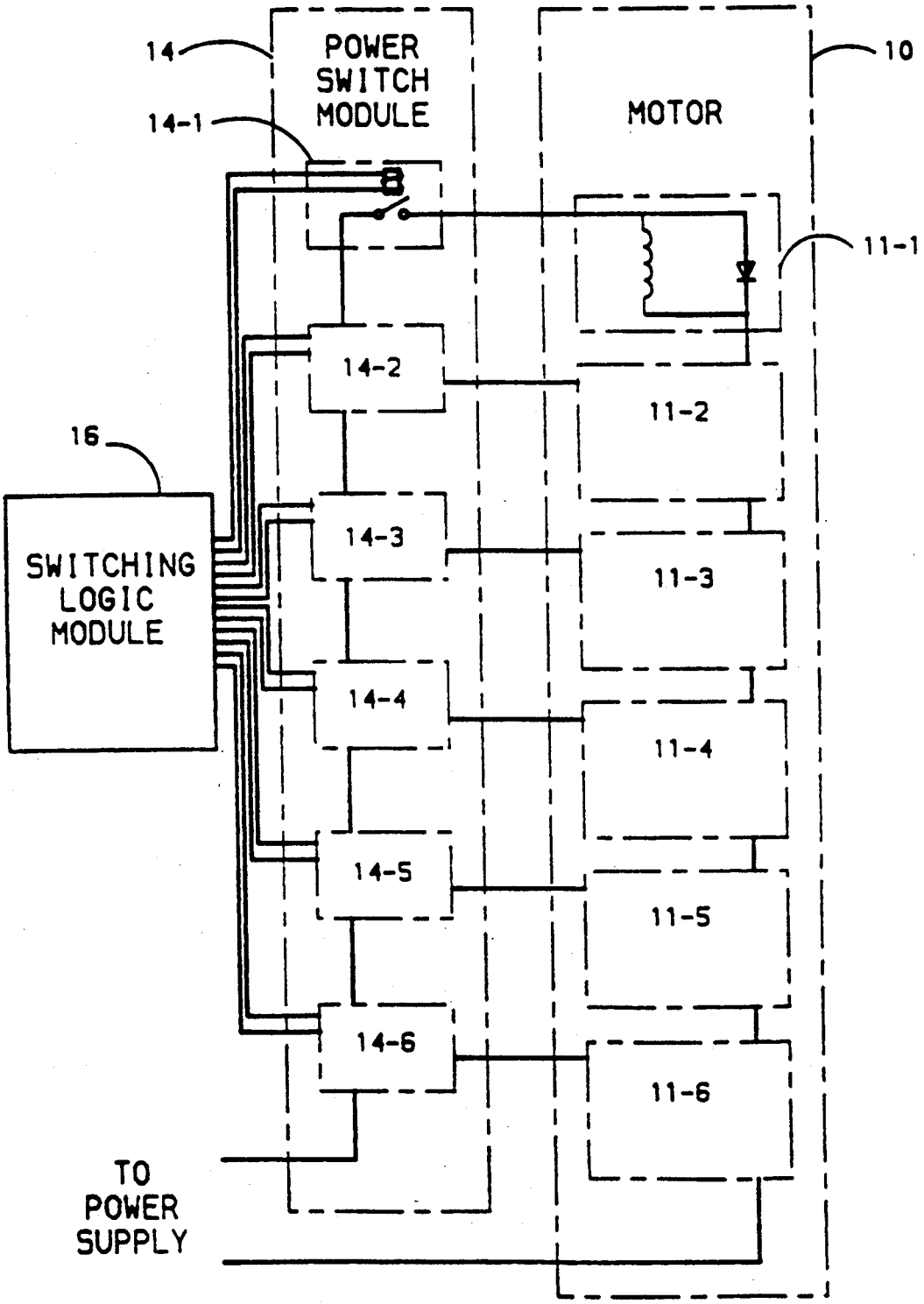
FIG. 2 is a more detailed view of the switching portion of the circuit of FIG. 1.
Figure 3:
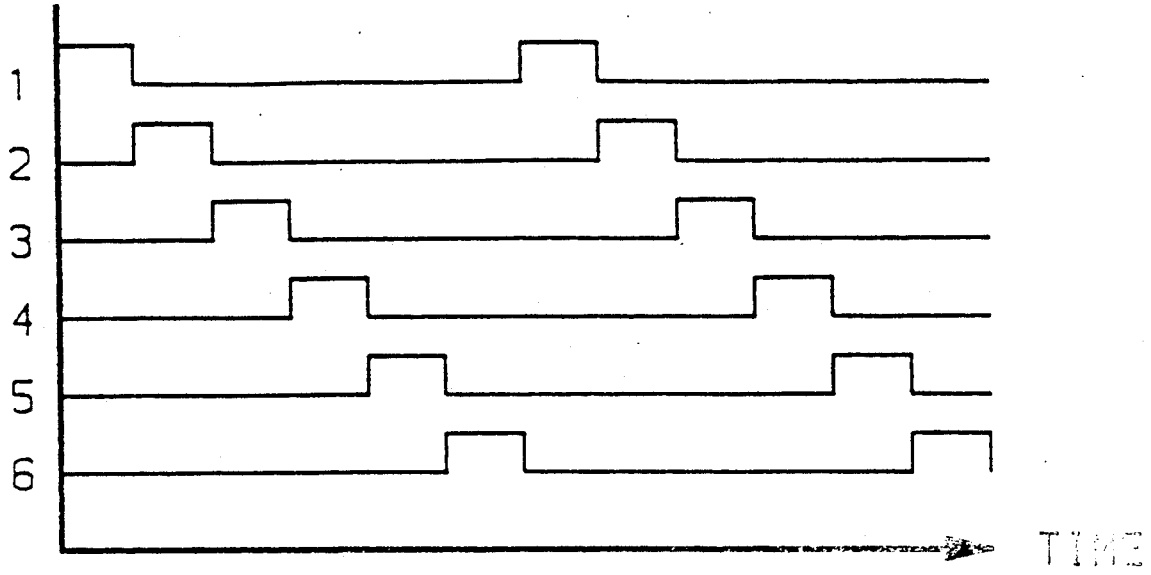
FIG. 3 is a graph showing the actuation of the switches as a function of time in the on at off mode.
Figure 4:
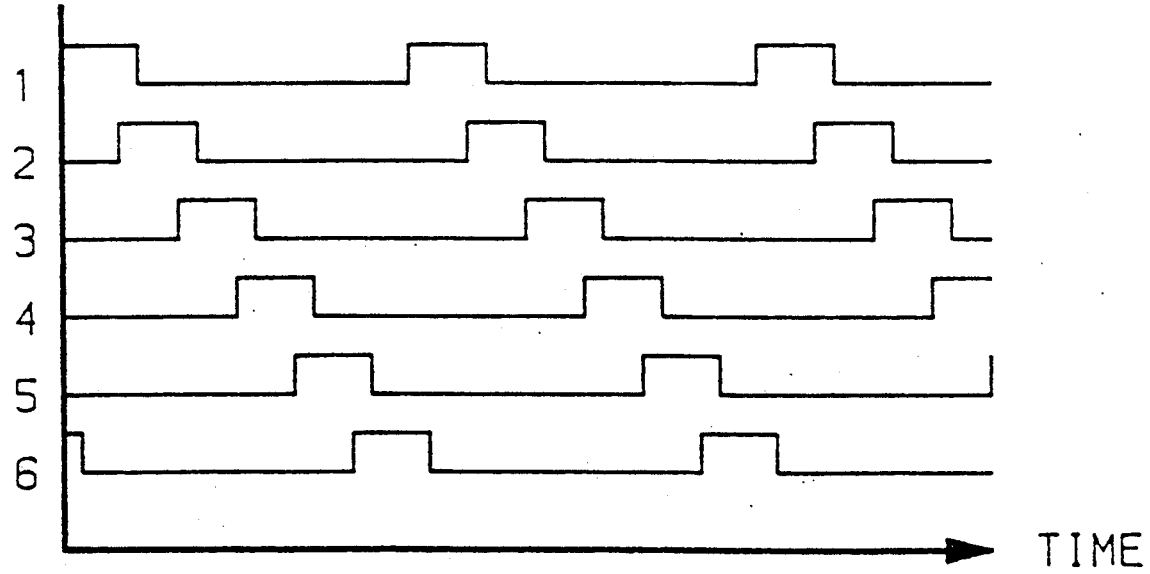
FIG. 4 is a graph showing the actuation of the switches as a function of time in the on before off mode.

In FIG. 1 the numeral 10 generally designates a rolling rotor motor which has a plurality of windings with six, 11-1 to 6, being illustrated. Power from power supply 12 is supplied to windings 11-1 to 6 by power switch module 14 under the control of switching logic module 16. Referring to FIG. 2, it will be noted that the power supply 12 is connected to windings 11-1 to 6 through switches 14-1 to 6 which are controlled by switching logic module 16. Switch 14-1 is illustrated as solenoid actuated but any suitable power switching may be employed. Switches 14-1 to 6, as illustrated in FIG. 3, can be actuated in an "on at off" mode wherein the shutting off of power to one winding coincides with the supplying of power to the next winding. Alternatively, as illustrated in FIG. 4, switches 14-1 to 6 can be actuated in an "on before off" mode wherein power is supplied to a winding for a short period of time after power is supplied to the next winding.

Figure 5:
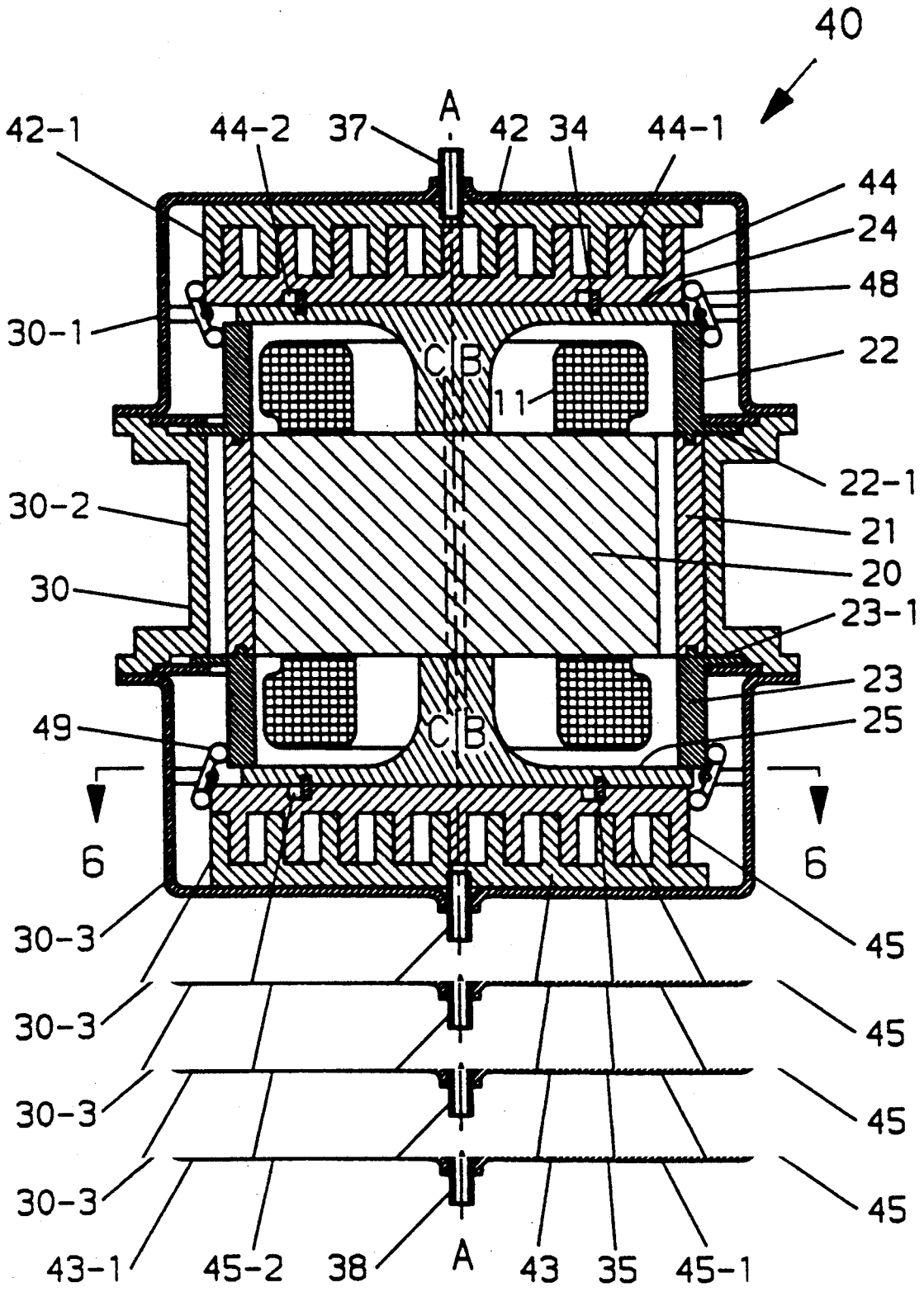
FIG. 5 is a vertical section of a rolling rotor motor driven scroll compressor taken along line 5—5 of FIG. 6.
Figure 6:
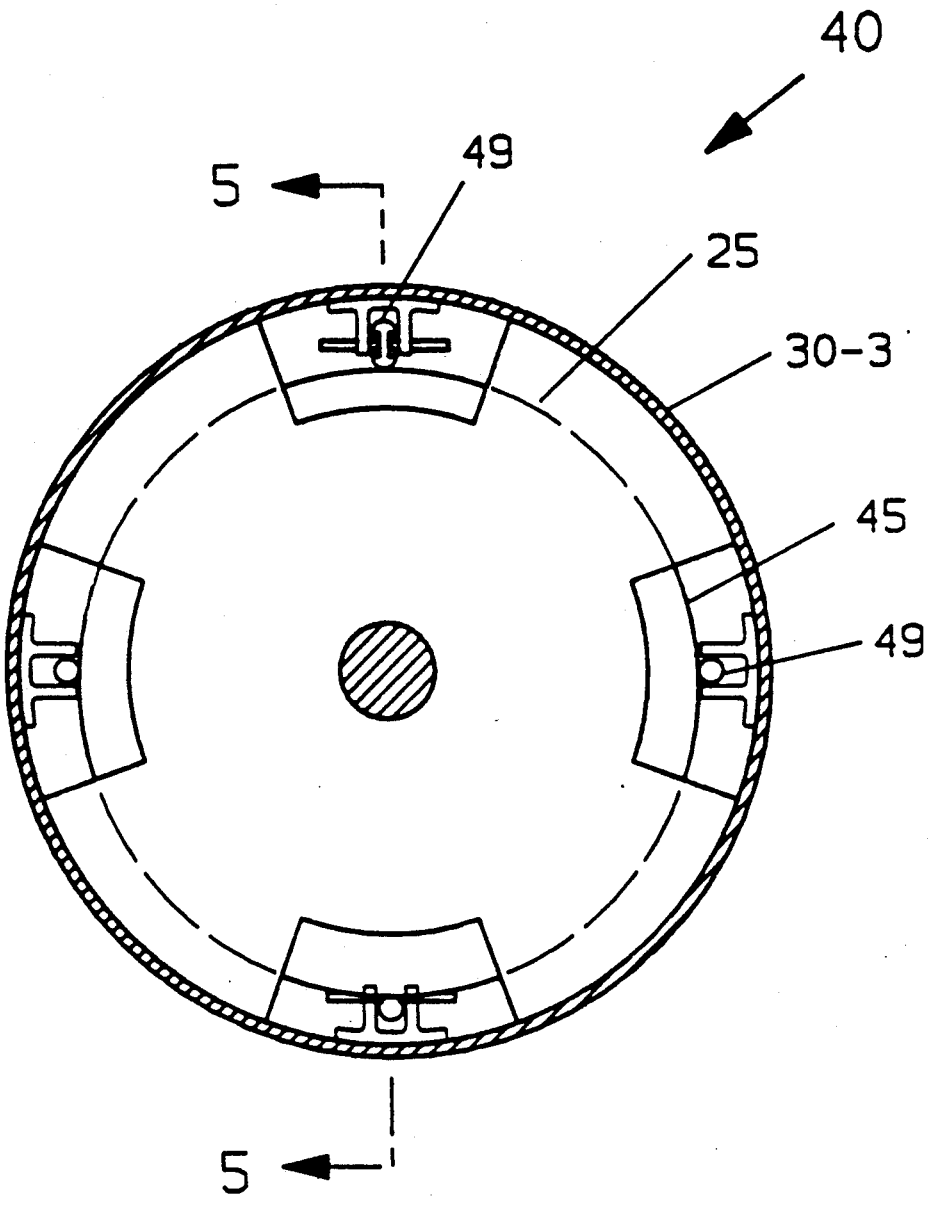
FIG. 6 is a sectional view taken along line 6—6 of FIG. 5.

In FIG. 5, the rolling rotor motor 10 of FIG. 1 and 2 is seen to include a fixed stator 20 with windings 11 and an external annular rotor 21 surrounding stator 20. Motor 10 is located in shell 30 of hermetic scroll compressor 40. Shell 30 is made up of upper section 30-1, middle section 30-2 and lower section 30-3 which are secured together in any suitable fashion such as by welding. Secured to the ends of rotor 21 are flanged annular extensions 22 and 23, respectively, which are movable with rotor 21 as a unit. Annular flanges 22-1 and 23-1 coact with shoulders on middle section 30-2 to axially position rotor 21 within shell 30. Stator 20 has a pair of axial extensions having end plates 24 and 25, respectively, defining bearing plates. Extensions 22 and 23 are movable with rotor 21, as a unit, and with end plates 24 and 25, define protective housings or covers for windings 11. End plates 24 and 25 are fixedly supported to upper shell section 30-1 and to lower shell section 30-2 respectively as shown in FIG. 6. Fixed scrolls 42 and 43 having wraps 42-1 and 43-1 respectively, are secured to upper section 30-1 and lower section 30-3, respectively. Wrap 44-1 of orbiting scroll 44 operatively engages wrap 42-1 of fixed scroll 42 and is supported by end plate 24. Similarly, wrap 45-1 of orbiting scroll 45 engages fixed scroll 43 and is supported by end plate 25. A first series of circumferentially spaced pivoted links 48 are fixedly supported and pivoted with respect to shell 30 but each simultaneously engages both orbiting scroll 44 and extension 22. Similarly, a second series of circumferentially spaced pivoted links 49 are fixedly supported and pivoted with respect to shell 30 but each simultaneously engages both orbiting scroll 45 and extension 23. The mass of rotor 21 and extensions 22 and 23, will be equal to the sum of the masses of the orbiting scrolls 44 and 45. If just one orbiting scroll 44 was present, then rotor 21, and extension 22 would have the same mass as orbiting scroll 44.

Figure 7:
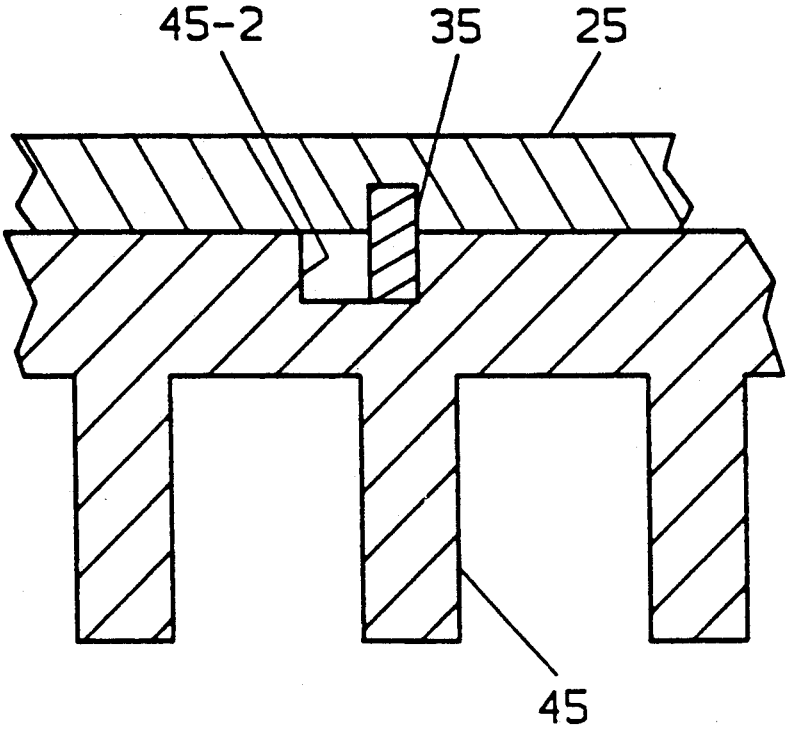
FIG. 7 is a enlarged view of a portion of FIG. 5.

In operation, as the magnetic field moves about the stator 20 through the selective activation of some of the windings, as described above, annular rotor 21 tends to follow the magnetic field and coacts with the stator 20. The annular rotor 21 thus tends to rotate about the stator 20 together with extensions 22 and 23. As extensions 22 and 23 move with the rotor 21 they act on links 48 and 49, respectively, causing orbiting scrolls 44 and 45 to be shifted so that they are 180° out of phase with the rotor 21 and the center of gravity of the orbiting scrolls 44 and 45 represented by C-C is on the opposite side of the centerline A-A of stator 20 than that of the integral member defined by rotor 21, and extensions 22 and 23 represented by B-B. Thus, the unit can be dynamically balanced with the correct selection or design of the parts using standard moment of inertia equations to balance the rotor 21 and its associated parts with the orbiting scrolls 44 and 45. If the axis B-B of rotor 21 coincided with A—A, links 48 and 49 would be parallel to A-A and B—B and orbiting scrolls 44 and 45 would not be out of phase with respect to rotor 21 but the scrolls 42-45 would not function to compress gas. Additionally, some type of anti-rotation device is necessary to maintain the proper orientation between the fixed and the orbiting scrolls. Also, it should be noted that the unrestrained movement of rotor 21 is to roll around stator 20 and this will result in a relative rotary movement between extensions 22 and 23 and links 48 and 49, respectively. As best shown in FIGS. 5 and 7, orbiting scrolls 44 and 45 each have one or more holes 44-2 and 45-2, respectively, formed therein and of a diameter equal to the diameter of the orbit of orbiting scrolls 44 and 45 plus that of pins 34 and 35, respectively. Pins 34 and 35 are fixedly located in end plates 24 and 25, respectively, and extend into and coact with recesses 44-2 and 45-2 in orbiting scrolls 44 and 45. Since the gas loads change with the compression process, there will be unbalance at some time since the centers of gravity do not accommodate these changes. However, the initial selection of the centers of gravity can chose some stage of the compression stroke at which balance is established. If a liquid slug, for example, was in the trapped volume of the compressor, its incompressibility would create an excess pressure. The orbiting scrolls 44 and 45 can move away from the fixed scrolls 42 and 43 thereby unsealing the trapped volume and permitting the orbiting scrolls 44 and 45 to override the liquid slug, grit, etc. Rotor 21 will be moved away from the stator 20 due to the coaction of linkages 48 and 49 when the orbiting scrolls 44 and 45 move away from the fixed scrolls 42 and 43.

For compressor operation, refrigerant at suction pressure is supplied from the refrigeration system (not illustrated) to the interior of shell 30 and refrigerant at discharge pressure is supplied to the refrigeration system (not illustrated) via lines 37 and 38, respectively in the conventional manner for a scroll compressor. Specifically as the magnetic field moves about the stator 20 annular rotor 21 together with extensions 22 and 23 roll around stator 21. As extensions 22 and 23 move they coact with links 48 and 49 which tend to maintain orbiting scrolls 44 and 45 180° out of phase with the rotor 21 and orbiting scrolls 44 and 45 coact with fixed scrolls 42 and 43, respectively, in the normal coaction of a scroll compressor. Orbiting scrolls 42 and 43 thus function as counterweights with respect to the rotor structure to thereby provide a dynamic balance. Pins 34 and 35 coact with recesses 44-2 and 45-2 to restrict relative movement between orbiting scrolls 44 and 45 and plates 24 and 25, respectively, to an orbiting motion which, in turn, restricts relative motion between orbiting scrolls 44 and 45 with fixed scrolls 42 and 43, respectively, to orbiting motion.

Although a preferred embodiment of the present invention has been illustrated and described, other changes will occur to those skilled in the art. For example, rotor 21 can be held to an orbiting motion and both extensions 22 and 23 and links 48 and 49 can be used when only a single orbiting scroll is used provided the mass of the orbiting scroll is equal to the combined mass of the rotor 21 and extensions 22 and 23. It is therefore intended that the scope of the present invention is to be limited only by the scope of the appended claims.

What is claimed is:

1. Scroll compressor means comprising:

hermetic housing means;

fixed scroll means fixedly located in said housing means;

orbiting scroll means having a center of gravity and located in said housing means so as to coact with said fixed scroll means;

stator means within said housing means and having an axis and a plurality of selectively activated windings;

annular rotor means within said housing means and having a center of gravity and surrounding said stator means so as to coact therewith to define a rolling rotor motor means such that when some of said windings are activated said rotor means is in line contact with said stator means; and linkage means connecting said rotor means and said orbiting scroll means such that said center of gravity of said rotor means and said center of gravity of said orbiting scroll means are maintained 180° out of phase with respect to said axis of said stator means so as to provide a dynamic balance when said rotor means drives said orbiting scroll means.

2. The scroll compressor means of claim 1 wherein said rotor means and said orbiting scroll means have equal masses.

3. The scroll compressor means of claim 1 wherein said annular rotor means includes an annular rotor having a first and a second end and axial extensions secured to said first and second ends and coacting with said linkage means.

4. The scroll compressor means of claim 1 further including means for causing said orbiting scroll means to orbit as said rotor means rotates.

5. The scroll compressor means of claim 1 wherein said linkage means includes a plurality of pivoted members engaging both said orbiting scroll means and said rotor means such that said centers of gravity of said orbiting scroll means and said rotor means move in symmetry with respect to said axis of said stator means.

6. The scroll compressor means of claim 1 wherein said fixed scroll means includes two fixed scrolls and said orbiting scroll means includes two orbiting scrolls;

7. Scroll compressor means comprising:

hermetic housing means;

fixed scroll means fixedly located in said housing means;

orbiting scroll means having a center of gravity and located in said housing means so as to coact with said fixed scroll means;

stator means within said housing means and having an axis and a plurality of selectively activated windings and coacting with said orbiting scroll means so as to permit orbiting movement of said orbiting scroll means;

annular rotor means within said housing means and having a center of gravity and surrounding said stator means so as to coact therewith to define a rolling rotor motor means such that when some of said windings are activated said rotor means is in line contact with said stator means; and linkage means connecting said rotor means and said orbiting scroll means such that said center of gravity of said rotor means and said center of gravity of said orbiting scroll means are maintained 180° out of phase with respect to said axis of said stator means so as to provide a dynamic balance when said rotor means drives said orbiting scroll means.

8. The scroll compressor means of claim 7 wherein said rotor means and said orbiting scroll means have equal masses.

9. The scroll compressor means of claim 7 wherein said annular rotor means includes an annular rotor having a first and a second end and axial extensions secured to said first and second ends and coacting with said linkage means.

10. The scroll compressor means of claim 7 wherein said linkage means includes a plurality of pivoted members engaging both said orbiting scroll means and said rotor means such that said centers of gravity of said orbiting scroll means and said rotor means move in symmetry with respect to said axis of said stator means.

11. The scroll compressor means of claim 7 wherein said fixed scroll means includes two fixed scrolls and said orbiting scroll means includes two orbiting scrolls.

* * * * *